United States Patent [19]

Dunn, Jr. et al.

[11] 4,258,649

[45] Mar. 31, 1981

[54] APPARATUS FOR COATING SURFACES

[75] Inventors: James L. Dunn, Jr., Lake Jackson; John K. Ward, Angleton, both of Tex.; Patrick H. Martin, Danville, Calif.

[73] Assignee: The Dow Chemical Company, Midland, Mich.

[21] Appl. No.: 757,417

[22] Filed: Jan. 6, 1977

Related U.S. Application Data

[63] Continuation-in-part of Ser. No. 589,226, Jun. 23, 1975, Pat. No. 4,007,304, and a continuation-in-part of Ser. No. 237,274, Mar. 23, 1972, abandoned.

[51] Int. Cl.[3] ..... B05B 1/28

[52] U.S. Cl. ..... 118/61; 118/64; 118/72; 118/326

[58] Field of Search ..... 118/61, 64, 65, 72, 118/73, 326

[56] References Cited

U.S. PATENT DOCUMENTS

| | | | |
|---|---|---|---|
| 1,930,601 | 10/1933 | Townsend | 118/65 |
| 2,024,248 | 12/1935 | Rafton | 118/61 |
| 2,812,269 | 11/1957 | Ransburg | 118/64 X |
| 3,030,913 | 4/1962 | Arnold et al. | 118/72 |
| 3,042,547 | 7/1962 | Pickett | 118/61 X |
| 3,067,056 | 12/1962 | Remer | 118/61 UX |
| 3,565,039 | 2/1971 | Remer | 118/61 X |
| 3,595,205 | 7/1971 | Surprenant | 118/61 |
| 3,924,569 | 12/1975 | Hunter et al. | 118/61 X |

*Primary Examiner*—Wm. Carter Reynolds
*Attorney, Agent, or Firm*—G. R. Baker

[57] ABSTRACT

An apparatus for applying a coating composition to an article and drying the solvent from the so applied coating prior to introduction of the coated article into the ambient atmosphere, comprising a housing or chamber in a generally "J" shape in which the small upwardly turned portion of the "J" defines an inner compartment isolated from the ambient atmosphere by the "J" configuration when the chamber is filled with a volatile solvent vapor and the inner compartment vapors are at an elevated temperature with respect to the remainder of the vapors in the chamber. The apparatus is provided with condensing means at the ambient atmosphere entrance and exit, a source of solvent vapors which may be integral with the chamber, and a means to introduce heat to the vapors and articles when they are in the inner compartment. The apparatus also includes article handling and moving means for transporting articles to be coated into, through and out of the apparatus as well as spray or dip means to apply the coating to the article.

2 Claims, 1 Drawing Figure

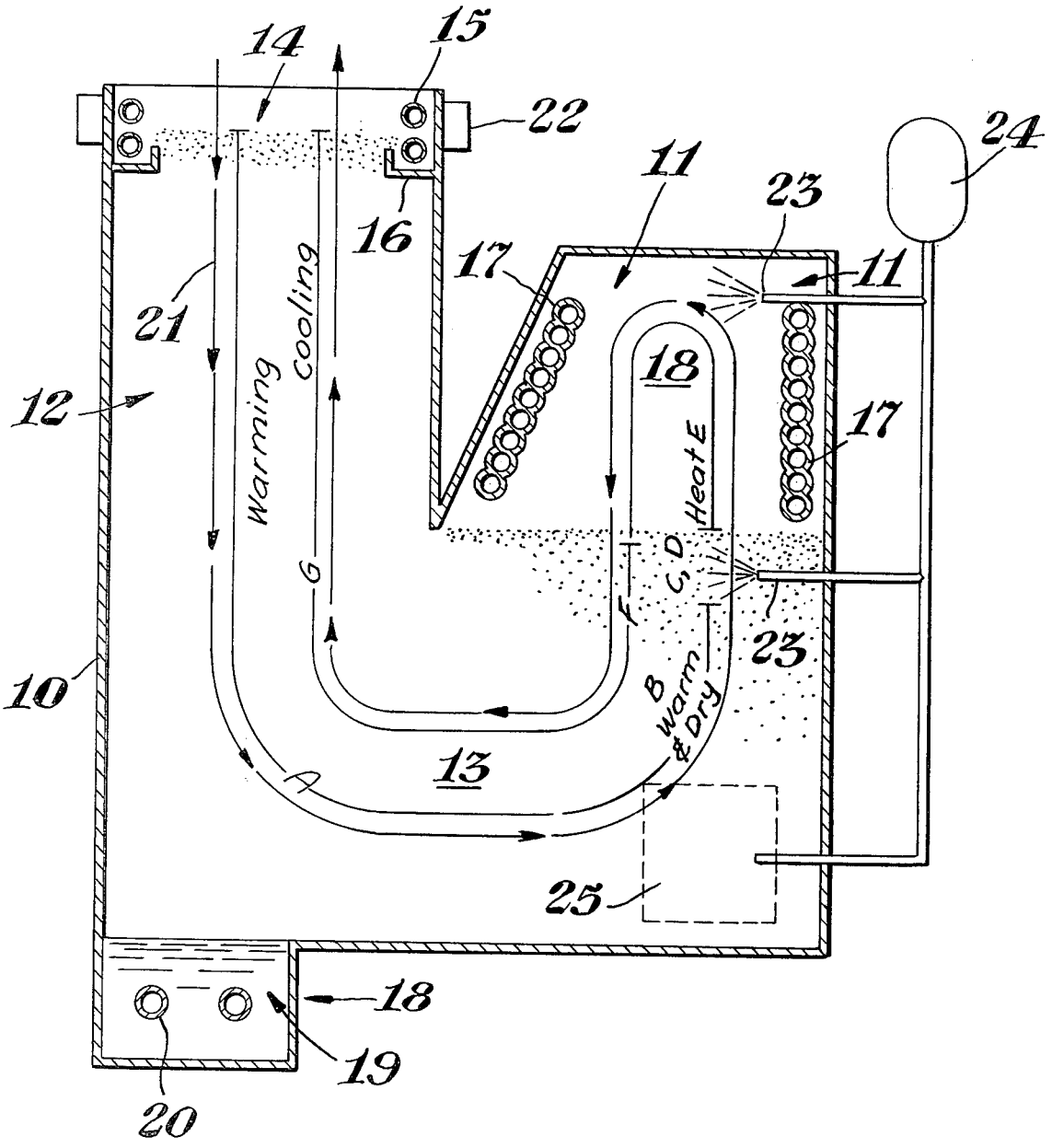
14
15
22
24
11
23
16
17
11
21
Warming
cooling
18
12
17
Heat E
G
D
C
F
23
10
B
Warm
& Dry
13
A
25
18
19
20

APPARATUS FOR COATING SURFACES

CROSS REFERENCE TO RELATED APPLICATIONS

This Application is a continuation-in-part of our copending applications Ser. No. 589,226, filed June 23, 1975, now U.S. Pat. No. 4,007,304, and Ser. No. 237,274, filed Mar. 23, 1972, now abandoned.

BACKGROUND OF THE INVENTION

The art of coating surfaces, as for example, painting a metal surface to impart a protective or decorative coating onto the metal surface, is an old and widely practiced art. The techniques for applying compositions which contain film-forming resins, both natural and synthetic and which may be pigmented, otherwise colored or opaqued, are varied, depending upon the compositions employed, the requirements of production and the skill of the appliers. Because most commercial coating compositions require rapid drying, solvents or vehicles employed for dissolving or suspending the film-forming materials, pigments and coloring or opaquing agents are normally highly volatile and, according to present day techniques, are lost to the ambient atmosphere. This has led to the employment of inexpensive materials such as toluene, V&PM naphthas and the like. However, because these solvents are flammable, little or no effort has been made to recover them and reuse them; as a matter of fact, some processes burn the vapors given off during the drying step. Recent demands for safer materials from the fire hazard standpoint has prompted exploration into the use of less flammable liquids such as the halogenated hydrocarbons. These materials are relatively expensive and therefore must be recovered if they are to be used industrially. Therefore, the use of these solvents has not gained any prominence in industrial coating processes.

The aforedescribed properties of the solvent vehicles, particularly their high volatility, contribute to uneven surfaces and the attendant loss of gloss of the coating. In some instances, a haze or "blush" develops as a result of high volatility and rapid evaporation, particularly on a moist or humid day. To overcome the loss of gloss and to produce a more uniform surface with greater reflective properties, the technique of thermal reflow, i.e., heating the thermoplastic coating to its softening point to permit it to level itself, is practiced as a normal phase of the required "bake." The "bake" is required to drive off residual solvent and, in some instances, to cause a reaction of the film-forming material, e.g., either chemical cross-linking, or a reaction somewhat similar to that achieved with driers in conventional paints and lacquers. Solutions to the many problems have been suggested, and in small scale operations, one answer again comes to the foreground—use of the less flammable solvents and blends of these solvents to obtain desirable drying times. This, as discussed above, has not become widespread because of its cost when employed in present-day techniques.

It is an object of the present invention to provide an apparatus for carrying out a process for coating surfaces with desirable film-forming materials, which may be pigmented, colored, opaqued or unpigmented, by application from substantially nonflammable organic solvents in an ecologically satisfactory manner.

A further object of the present invention is to provide an apparatus for carrying out a process for coating surfaces utilizing a nonflammable organic solvent and recovering the solvent for reuse thereby to provide an economically satisfactory process.

A still further object of the present invention is to provide an apparatus for carrying out a process for coating surfaces which requires no release of solvents to the atmosphere during "drying" and if a thermal bake or cure is necessary or desirable, the apparatus is useful in a process which produces low residual solvent content in the surface coating thereby reducing solvent released to the atmosphere during bake or cure, thus providing an ecologically satisfactory process.

Another object of the present invention is to provide an apparatus for use in a process for coating which permits the preparation of coatings of up to 2 or more mils in thickness in a single application of coating composition which coatings have a high gloss, level coat in time periods equal to or less than that time normally required to obtain equivalent coat thickness using the conventional solvents and coating techniques.

A still further object is to provide an apparatus which permits a primer coating to be applied followed by one or more top coats without intermediate baking or curing of the primer coat or the top coats.

These and other objects and advantages of the present process will be apparent to those skilled in the art from the following description and claims.

FIG. 1 represents in side elevation an apparatus suitable for carrying out the process of the invention claimed and described in Ser. No. 589,226, filed June 23, 1975 now U.S. Pat. No. 4,007,304, showing the path of the article through the apparatus.

BRIEF DESCRIPTION OF INVENTION

The apparatus of the present invention (for coating an article with a volatilizable solvent containing coating composition, removing the volatilizable solvent from the coating and recovering the solvent) comprises:

a chamber of substantial J shape having an opening to the ambient atmosphere in the upper surface of the longer leg;

said opening being provided with a cold wall exterior and adjacent said opening for conducting a cooling fluid therethrough;

said opening being provided with a condensing means interior and adjacent said opening for conducting a cooling medium therethrough;

a trough immediately below said condensing means, said trough having liquid communicating means associated therewith for delivery of liquid from said trough to a storage area;

a means located in the bottom third of said chamber for holding a liquid vaporizable solvent and having means associated therewith to heat said solvent to produce vapors;

a means associated with said chamber to supply and apply a coating composition in a spray form to the interior of said chamber;

a means in the up-turned portion of said J for heating vapors and articles in said portion, said means being of sufficient size and location to generate superheated vapors in said portion and heat any article passing therethrough to above the atmosphere boiling point of said solvent; and means associated with the interior of said chamber to convey articles to be coated into said chamber through said chamber and said up-turned portion and out of said chamber.

DETAILED DESCRIPTION OF INVENTION

The apparatus illustrated in the FIGURE comprises an enclosure (10), having two zones (11 and 12) extending from chamber 13. Zone (11) is shorter than zone (12) and is closed to the atmosphere. Zone (12) is open to atmosphere at a point (14) above the upper most height of zone (11). Interior of the opening (14) of zone (12) is a cooling means (15) and a condensate collecting trough (16) for collecting condensation which forms on cooling means (15). Within zone (11) is located a heating means (17) which provides a source of heat to the zone. Located near the bottom of chamber (13) is a sump (18) containing a vaporizable liquid (19) and means (20) for vaporizing the liquid (19). A conveyor means (21) is located within enclosure (10) in a manner to transport an item from the opening (14) down zone (12), across chamber (13), up into zone (11) and return the item in reverse order to the opening (14). The exterior of enclosure (10) is insulated to reduce loss of heat from the enclosure. A cold wall (22) may be located exterior of but integral with the walls of zone (12) to maintain the walls of zone (12) from carrying heat above the level of cooling means (15) i.e. the introduction of and the flow of a cooling fluid therethrough. Located within zone (11) is a coating application means (23) which is illustrated as spray nozzles. The nozzles are supplied a heated coating composition from a reservoir (24) under pressure, preferably hydraulic pressure. Alternatively, the coating may be applied from a dip tank represented by area (25).

In a representative operation of the apparatus of the present invention a 4"×12" panel of sheet steel was coated with a titanium pigmented acrylic acid ester lacquer dissolved and suspended in trichloroethylene at 40.5% solids. The coating operation was run on a conveyor passed through the apparatus at 40 feet per minute. The coating composition was applied from an airless spray nozzle orifice under 1,000 psi pressure. The application was made in the lower part of zone (11) at 140° C. The paint was dried on the panel while maintaining this temperature for 30 seconds; the painted panel was then conveyed to the top of zone (11) where, at a temperature of 165° C., it was dried further for 60 seconds. The panel was then removed to the ambient atmosphere and over-baked for 15 minutes. The coating was 2.0 mils thick and by visual observation had a high gloss, appeared level with no apparent surface imperfections and adhered well to the panel.

Coatings applied according to conventional commercial procedures, in air, employing similar coating compositions with conventional lacquer solvents require several (2 or more) spray passes to obtain 2 mils of film thickness and require a 15 to 30 minutes bake at about 160° C. to obtain a level glossy coat having good adhesion.

The apparatus of the present invention permits establishing a controlled environment having an ambient atmosphere interface and having a zone or series of zones of substantially air-free vapors of a volatile organic solvent, preferably nonflammable vapors, and more preferably, the same organic solvent employed in the coating vehicle composition. Each zone within the environment is remote from the ambient atmosphere. The article to be coated is introduced into and through the interface into the environment, thence into and through a zone or zones of higher temperature vapors of the environment while performing the application, gelation and drying of the coating. The employment of such a zone or zones provides a favorable condition(s) for the application of the coating, the gelation of the coating, and the evaporation of the coating solvent vehicle, each at a controlled rate; that is to say, the evaporation of solvent vehicle from the coating during each step is controlled at such a rate as to:

(1) cause rapid gelation, yet prevent "skinning over" of the film surface, (2) cause vaporization of solvent vehicle at a rapid enough rate to prevent sagging or running of the coating composition, and (3) cause vaporization of solvent vehicle at a slow enough rate to permit leveling of the coating to develop a maximum reflective surface necessary to high gloss appearance.

The apparatus of the process in its broadest aspect consists of:

(1) establishing a chamber to contain an environment said chamber having an interface with the ambient atmosphere, the chamber being capable of containing an environment consisting of substantially air-free vapor of a volatile medium which is stable under the temperature of operation, preferably nonflammable, and which is either the same as or is capable of separation from the coating solvent vehicle to be used in the coating process, (2) providing within the chamber means to generate a zone or zones of vapor at a temperature or temperatures at least ten degrees above the boiling point of the highest boiling constituent of the solvent vehicle for the coating composition, which zone or zones within the chamber are remote from the ambient atmosphere, (3) providing a means for applying a coating composition containing a volatilizable solvent vehicle for the film-forming material and pigments or coloring agents, in a heated state and in its liquid state under pressure, (4) means for introducing the article or substrate into the chamber and pass the same through the chamber and its mediate zone to bring at least its surface temperature to about the environment temperature, through a zone for applying the coating, thence into a zone to maintain the so-coated substrate at the same temperature in the same zone or at a different, preferably higher, temperature, in a contiguous zone to effectuate gelation of the coating, drying of the coating and finally exiting the now dry, tack-free, substantially solvent-free coated substrate from the environment to the ambient temperature.

The steps of the process in their broadest aspect consist of:

(1) establishing an environment having an interface with the ambient atmosphere and consisting of substantially air-free vapor of a volatile medium which is stable under the temperature of operation, preferably nonflammable, and which is either the same as or is capable of separation from the coating solvent vehicle, (2) providing within the environment a zone or zones of vapor at a temperature or temperatures at least ten degrees above the boiling point of the highest boiling constituent of the solvent vehicle for the coating composition, which zone or zones are remote from the ambient atmosphere, (3) providing a coating composition containing a volatilizable solvent vehicle for the film-forming material and pigments or coloring agents, if any, which can be heated in its liquid state under pressure to a temperature sufficient that during its application to a substrate, such as a metal sheet, evaporation of its solvent will not materially affect, that is alter, the temperature of the environment, including the zone or zones, or the surface to which the coating is applied, i.e., materially cooling the environment, zone or zones or surface, (4) introducing the article or substrate into the environment for a time sufficient to bring at least its surface temperature to about the environment temperature, (5) introducing the substrate into a zone, or the first of such zones, within the environment and maintaining it therein to raise its surface temperature to near that of the zone, (6) applying the coating, (7) maintaining the so-coated substrate at the same temperature in the same zone or at a different, preferably higher, temperature, in a contiguous zone to effectuate gelation of the coating, (8) maintaining the gelled coated substrate at the same temperature in the same zone or at a different temperature in a contiguous zone to effectuate the evaporation of the solvent from the gelled coating, drying it, and (9) withdrawing the now dry, tack-free, substantially solvent-free coated substrate from the environment.

The temperature of the environment and the temperature of the zone or zones are each independently established to prevent loss of solvent to the ambient atmosphere and to provide a transfer of heat to the substrate and coating composition to effectuate an optimum gelation and rapid drying of the coating. The apparatus by its very nature, in order to remove solvent vehicle from the coating, must possess, in the remote zone or zones wherein solvent vehicle is vaporized from the coating, a minimum temperature of at least several degrees above the coating composition solvent vehicle boiling temperature. However, to minimize loss of solvent to the ambient atmosphere, the environment temperature must be such that at the interface between the ambient atmosphere and the environment the vapors of environment are capable of condensing with minimum loss of solvent to the ambient atmosphere.

Thus, the zone temperature(s) must be sufficiently above the vehicle solvent boiling point such that the cooling effect of the evaporation of solvent vehicle from the coating (which is accomplished principally by the heat content of the vapors in the zone) will not lower the heat content of the zone.

The means for establishing the environment and the zones therein is not critical and several means will become apparent immediately to those skilled in the art. For example, one means for accomplishing the temperature control of the environment is to provide heaters within the environment which radiate and conduct heat to the environment. Another means for providing adequate temperature control of the environment is to withdraw a portion of the vapors continuously and heat the withdrawn vapors outside the environmental enclosure and return them in their heated condition to the environmental enclosure.

What is claimed is:

1. An apparatus for applying a coating from a volatile organic solvent, removing the solvent from said coating and recovering said solvent which comprises:

a substantially J-shaped chamber having an opening to the ambient atmosphere in the upright main leg of the J;

a condensing means interior of and adjacent said opening for condensing vapors of a solvent when filling the chamber;

a condensate collecting trough beneath said condensing means, said trough connected with a storage area;

a means for producing and supplying vapors of a liquid vaporizable solvent associated with said chamber;

a means for applying a coating composition containing a vaporizable solvent;

a means for heating articles and vapors located in the upturned short portion of the J above the turn;

a means for conveying articles to be coated into through and out of said J shaped chamber.

2. An apparatus for coating an article with a volatilizable solvent containing coating composition, removing the volatilizable solvent from the coating and recovering the solvent which apparatus comprises:

a chamber of substantial J shape having an opening to the ambient atmosphere in the upper surface of the longer leg;

said opening being provided with a cold wall exterior and adjacent said opening for conducting a cooling fluid therethrough;

said opening being provided with a condensing means interior and adjacent said opening for conducting a cooling medium therethrough;

a trough immediately below said condensing means, said trough having liquid communicating means associated therewith for delivery of liquid from said trough to a storage area;

a means located in the bottom third of said chamber for holding a liquid vaporizable solvent and having means associated therewith to heat said solvent to produce vapors;

a means associated with said chamber to supply and apply a coating composition in a spray form to the interior of said chamber;

a means in the up-turned portion of said J for heating vapors and articles in said portion, said means being of sufficient size and location to generate superheated vapors in said portion and heat any article passing therethrough to above the atmospheric boiling point of said solvent; and means associated with the interior of said chamber to convey articles to be coated into said chamber through said chamber and said up-turned portion and out of said chamber.

* * * * *

UNITED STATES PATENT AND TRADEMARK OFFICE

CERTIFICATE OF CORRECTION

PATENT NO. : 4,258,649

DATED : March 31, 1981

INVENTOR(S) : J. L. Dunn, J. K. Ward, P. H. Martin

It is certified that error appears in the above-identified patent and that said Letters Patent are hereby corrected as shown below:

Column 2, line 65, change "atmosphere" to --atmospheric--.
Column 3, line 12; change "condensation" to --condensate--.
Column 3, line 26; change first occurrence of "the" to --by--.
Column 3, line 7; delete second occurrence of "the".
Column 3, line 48; change "over-baked" to --oven-baked--.

The sheet of drawing should appear as shown on the attached sheet.

Signed and Sealed this

*Fifteenth* Day of *September 1981*

[SEAL]

*Attest:*

GERALD J. MOSSINGHOFF

*Attesting Officer*

*Commissioner of Patents and Trademarks*

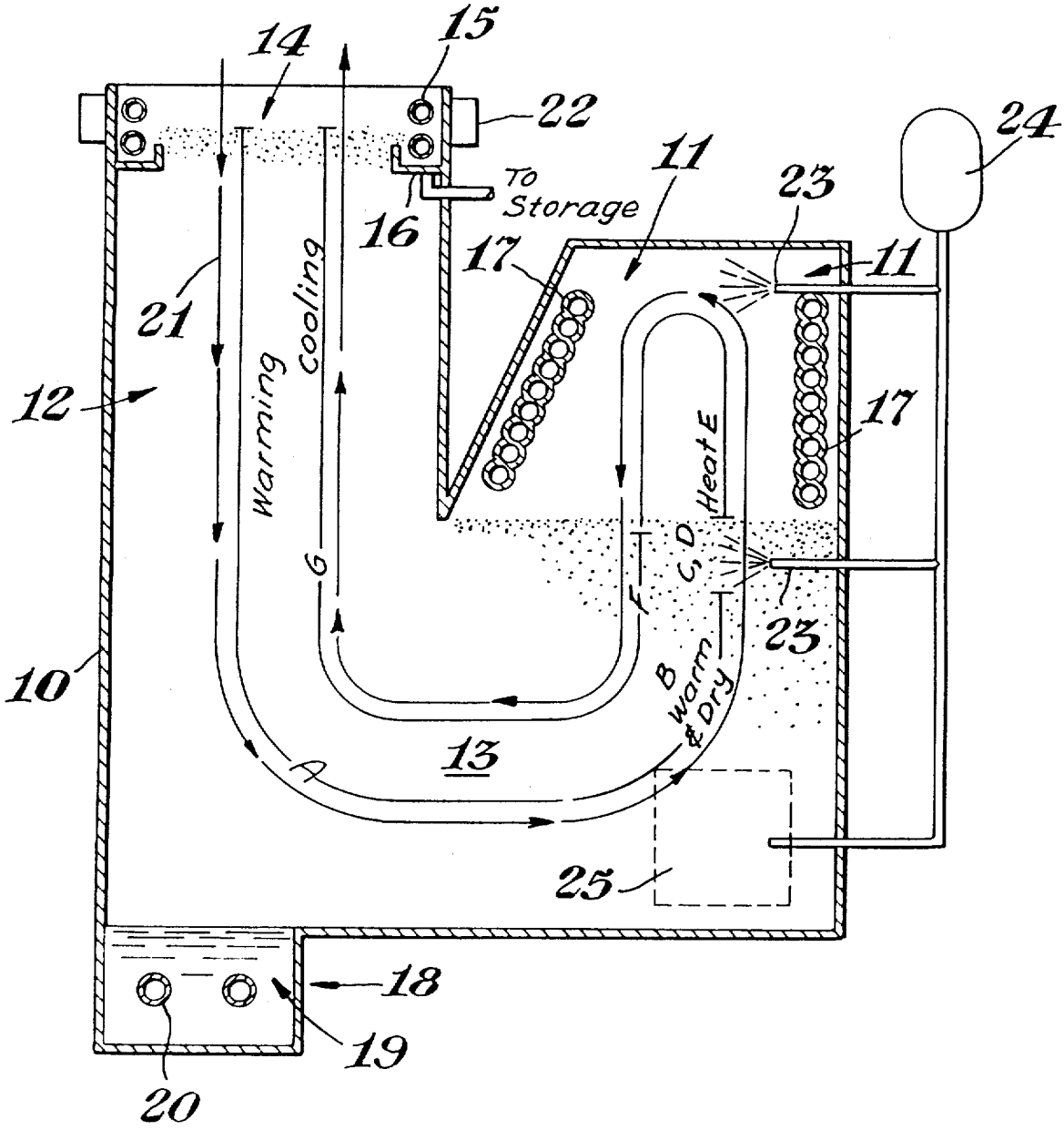
14
15
22
24
11
To Storage
23
16
17
11
21
Cooling
Warming
12
17
Heat E
D
C
G
F
23
B
Warm & Dry
10
13
A
25
18
19
20